US008821140B2

(12) United States Patent
Paval et al.

(10) Patent No.: US 8,821,140 B2
(45) Date of Patent: Sep. 2, 2014

(54) GEAR PUMP

(76) Inventors: Dan Paval, Calgary (CA); Ivan Polancec, Calgary (CA)

( * ) Notice: Subject to any disclaimer, the term of this patent is extended or adjusted under 35 U.S.C. 154(b) by 924 days.

(21) Appl. No.: 12/769,702

(22) Filed: Apr. 29, 2010

(65) Prior Publication Data

US 2011/0268598 A1 Nov. 3, 2011

(51) Int. Cl.
*F04C 15/00* (2006.01)

(52) U.S. Cl.
USPC ..... 418/83; 418/88; 418/203; 277/500; 285/314

(58) Field of Classification Search
USPC ..... 418/83, 206.6, 88, 85, 180, 203; 148/104; 48/170; 277/500, 510, 511; 285/314–316
See application file for complete search history.

(56) References Cited

U.S. PATENT DOCUMENTS 1,620,261 A * 3/1927 Kennedy ..... 418/203
1,673,259 A * 6/1928 Meston et al. ..... 418/98
1,933,820 A * 11/1933 Mueller ..... 261/28
2,006,833 A * 7/1935 Jensen ..... 285/277
2,080,121 A * 5/1937 Fleming ..... 277/329
2,136,142 A * 11/1938 Meurling ..... 418/83
2,504,230 A * 4/1950 Smith ..... 418/99
2,512,644 A * 6/1950 Hauber ..... 239/87
2,957,428 A * 10/1960 Meyer et al. ..... 418/206.8
3,074,747 A * 1/1963 Boughton ..... 285/342
3,131,643 A * 5/1964 Marietta ..... 418/132
3,156,191 A * 11/1964 Lauck ..... 418/102
3,351,359 A * 11/1967 Ferraris ..... 285/7
3,529,805 A * 9/1970 Callahan, Jr. et al. ..... 251/88
3,587,032 A * 6/1971 Normann ..... 439/321
3,588,126 A * 6/1971 McKillop et al. ..... 277/511
3,590,790 A * 7/1971 Keylwert et al. ..... 418/83
3,704,968 A * 12/1972 Haupt ..... 418/178
3,830,602 A * 8/1974 Boop et al. ..... 418/131
4,662,771 A * 5/1987 Roe et al. ..... 403/108
4,878,820 A * 11/1989 Doi et al. ..... 418/203
4,986,740 A * 1/1991 Adachi ..... 418/83
5,030,150 A * 7/1991 Herzhauser ..... 440/112
5,090,087 A * 2/1992 Hipple et al. ..... 15/317
5,281,115 A * 1/1994 Timuska ..... 418/9
5,284,427 A * 2/1994 Wacker ..... 418/83
5,290,009 A * 3/1994 Heilmann ..... 251/149.6
5,322,329 A * 6/1994 Michael ..... 285/38
5,549,305 A * 8/1996 Freund ..... 277/511
6,098,988 A * 8/2000 Kawakami et al. ..... 277/440
6,129,334 A * 10/2000 Kuwabara ..... 251/149.6
6,168,161 B1 * 1/2001 Majcen ..... 277/308
6,301,898 B1 * 10/2001 Choroszylow et al. ..... 60/734
6,497,563 B1 * 12/2002 Steffens ..... 418/88
6,568,717 B1 * 5/2003 Le Clinche ..... 285/315
6,688,857 B1 * 2/2004 Choroszylow et al. ..... 417/313
6,779,778 B2 * 8/2004 Kuwabara ..... 251/149.9
6,824,368 B2 * 11/2004 Luigi ..... 418/83
7,118,089 B2 * 10/2006 Mikiya et al. ..... 251/149.2

(Continued)

*Primary Examiner* — Thai Ba Trieu
*Assistant Examiner* — Thomas Olszewski
(74) *Attorney, Agent, or Firm* — David A. Guerra

(57) ABSTRACT

A gear pump having double-helical gears with bearing assembly seals and gear end seals which provided double seal interfaces between the pump cavity and bearing cups having disposed therein bearing assemblies for supporting pump shafts for rotation. The double seal interfaces preclude pumped fluid, particularly contaminated fluid including entrained abrasives from making contact with the bearing assemblies. An adjustable packing seal mechanism, a gear gap adjustment mechanism, a fluid pressure relief system, and pump heat exchanger features are also disclosed.

8 Claims, 11 Drawing Sheets

(56) References Cited

U.S. PATENT DOCUMENTS

| | | | | |
|---|---|---|---|---|
| 7,121,554 | B2 * | 10/2006 | Lugovskoy et al. | 277/531 |
| 7,549,679 | B2 * | 6/2009 | Brosius et al. | 285/340 |
| 7,588,431 | B2 * | 9/2009 | O'Brien, II | 418/206.1 |
| 7,874,820 | B2 * | 1/2011 | Shoulders | 418/201.2 |
| 7,887,310 | B2 * | 2/2011 | Flanigan et al. | 418/201.2 |
| 8,038,423 | B2 * | 10/2011 | Nakayoshi | 418/171 |
| 8,113,183 | B2 * | 2/2012 | Prior et al. | 123/559.1 |
| 8,136,792 | B2 * | 3/2012 | King | 251/214 |
| 2004/0047755 | A1 * | 3/2004 | Kuramoto et al. | 418/83 |
| 2007/0102139 | A1 * | 5/2007 | Puggioni et al. | 165/72 |
| 2009/0004038 | A1 * | 1/2009 | Prior et al. | 418/85 |
| 2010/0008804 | A1 * | 1/2010 | Liska | 417/559 |

* cited by examiner

GEAR PUMP

FIELD OF THE INVENTION

The present invention relates generally to pumps used to pump liquids entrained with abrasives, and more particularly, relating to a gear pump including double-helical gears of an construction which reduces end plate wear, reduces the tendency for contaminated fluids fouling pump shaft bearing assemblies, permits packing seal adjustment to compensate for seal wear, and permits the adjustment of gear gap between meshing gear teeth.

BACKGROUND OF THE INVENTION

Pumping liquids and fluids, such as oils and distillates produced from oil wells, presents a problem as these fluids frequently contain entrained contaminating materials such as sand, grit and the like. The pumping of such fluids results in the entrained abrasive materials coming into contact with the pump elements, and in particular, the pump surface elements as well as the pump shaft bearings and seals. Consequently, pumps in service for pumping such liquids require frequent maintenance and repair as a result of premature wear and failure after a relatively short period of use. Pumps employing meshing gears are often used to pump such fluids. Such gear pumps typically include single-helical gears that in operation, as a result of contact between the meshed gear teeth, create axial thrust forces along the pump shafts, which causes an increase in end plate wear.

To address these problems, pumps include modular designs to increase the serviceability of the pump and reduce overall pump downtime, include wear plates to take the axial thrust forces along the pump shafts to reduce end plate wear, and include bearing assemblies and seal arrangements that operate to reduce the tendency of contaminated fluid contact with the bearing assemblies.

Another problem encountered is leaking of fluid externally of the pump due to a worn dynamic packing seal that is used to provide a seal between the protruding end of the pump driving shaft and the pump housing or end plate. Heretofore, servicing and replacement of the packing seal required the pump to be shutdown.

Another problem encountered is the formation of area of high pressurized fluid at the end of a pump shaft created during the pump operation. The pressurized fluid creates an axially loading on the pump shaft causing the pump shaft to be urged towards the opposite end resulting in an increase of pump component wear.

Accordingly, there is a need for a pump design used to pump fluids contaminated with abrasives that has an increased service life and an improved serviceability and that overcomes the limitations associated with conventional pump designs heretofore.

SUMMARY OF THE INVENTION

In general, in one aspect, a gear pump is provided including a pump housing having opposite ends. A gear is disposed within the pump housing and includes opposed and outwardly facing first and second ends. The first end having a first gear end seal mount, and the second end having a second gear end seal mount. First and second end plates are sealingly joined to the opposite ends of the pump housing. The first end plate has a first shaft passage to receive a pump shaft therethrough and a first seal disc mount on an inner side of the first end plate coaxial with the first shaft passage. The second end plate has a second shaft passage to receive a pump shaft therethrough and a second seal disc mount on an inner side of the second end plate coaxial with the second shaft passage. A first seal disc is mounted to the first seal disc mount. A second seal disc is mounted to the second seal disc mount. A pump shaft having a first shaft end extends through the first shaft passage and the first seal disc, and a second shaft end extends through the second shaft passage and the second seal disc. The gear is fixedly joined to the pump shaft for rotation therewith. A first gear end seal is mounted to the first gear end seal mount and forms a sealing contact between an inner facing side the first seal disc and the first outwardly facing end. A second gear end seal is mounted to the second gear end seal mount and forms a sealing contact between an inner facing the second seal disc and the second outwardly facing end.

In general, in another aspect, a gear pump includes a first fluid flow passage between the first shaft end and a first discharge/suction port, and a second fluid flow passage between the first shaft end and a second discharge/suction port. Fluid at the first shaft end flows through either of the first or the second fluid passage upon the fluid reaching a pressure above a threshold pressure to vent the fluid at the first shaft end to either of the first or the second discharge/suction ports, respectively.

In general, in another aspect, a gear pump includes a seal neck including a body having opposed first and second ends and a seal neck shaft passage extending between the first and second ends. The seal neck mounted to the end plate and the pump shaft extending through the seal neck passage and protruding beyond the second end of the seal neck. First and second bushings disposed in the seal neck shaft passage and supporting the pump shaft for rotation. A packing seal disposed within the seal neck shaft passage about the pump shaft and interdisposed between the first and the second bushings. A packing nut including a bore is threadably attached to the second end of the body of the seal neck. The pump shaft extending through the bore of the packing nut, wherein threading the packing nut on the second end compresses the packing seal between the first and the second bushings. A pair of check balls, each disposed in a hole extending through a body of the packing nut. A collar attached to packing nut about the body thereof. The collar captivity retaining the pair of check balls in the holes and rotatable about the body between first and second positions. The collar including a pair of cavities on an interior surface thereof. The seal neck including a plurality of flat lands circumferentially spaced on an exterior surface thereof. The collar is rotated into the first position the cavities are registered with the holes through the packing nut body and the check balls are partially received within the cavities permitting the check balls to float across the flat lands as the packing nut is threaded, and wherein the collar is rotated into the second position the check balls are restrained from floating across the flat lands.

In general, in another aspect, a gear pump includes double-helical gears shrunk fit to respective driving and idler pump shafts.

In general, in another aspect, a gear pump includes a plug member threadably received by a plug bore through the first end plate along the axis of the pump shaft. The first shaft end of the pump shaft including an axial bore. A ball is disposed between the first shaft end and a cup of an inward end of the plug member.

There has thus been outlined, rather broadly, the more important features of the invention in order that the detailed description thereof that follows may be better understood and in order that the present contribution to the art may be better appreciated.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The accompanying drawings, which are included to provide further understanding of the invention and are incorporated in and constitute a part of this specification, illustrate preferred embodiments of the invention and together with the description serve to explain the principles of the invention, in which.

DETAILED DESCRIPTION OF THE INVENTION

Figure 1:
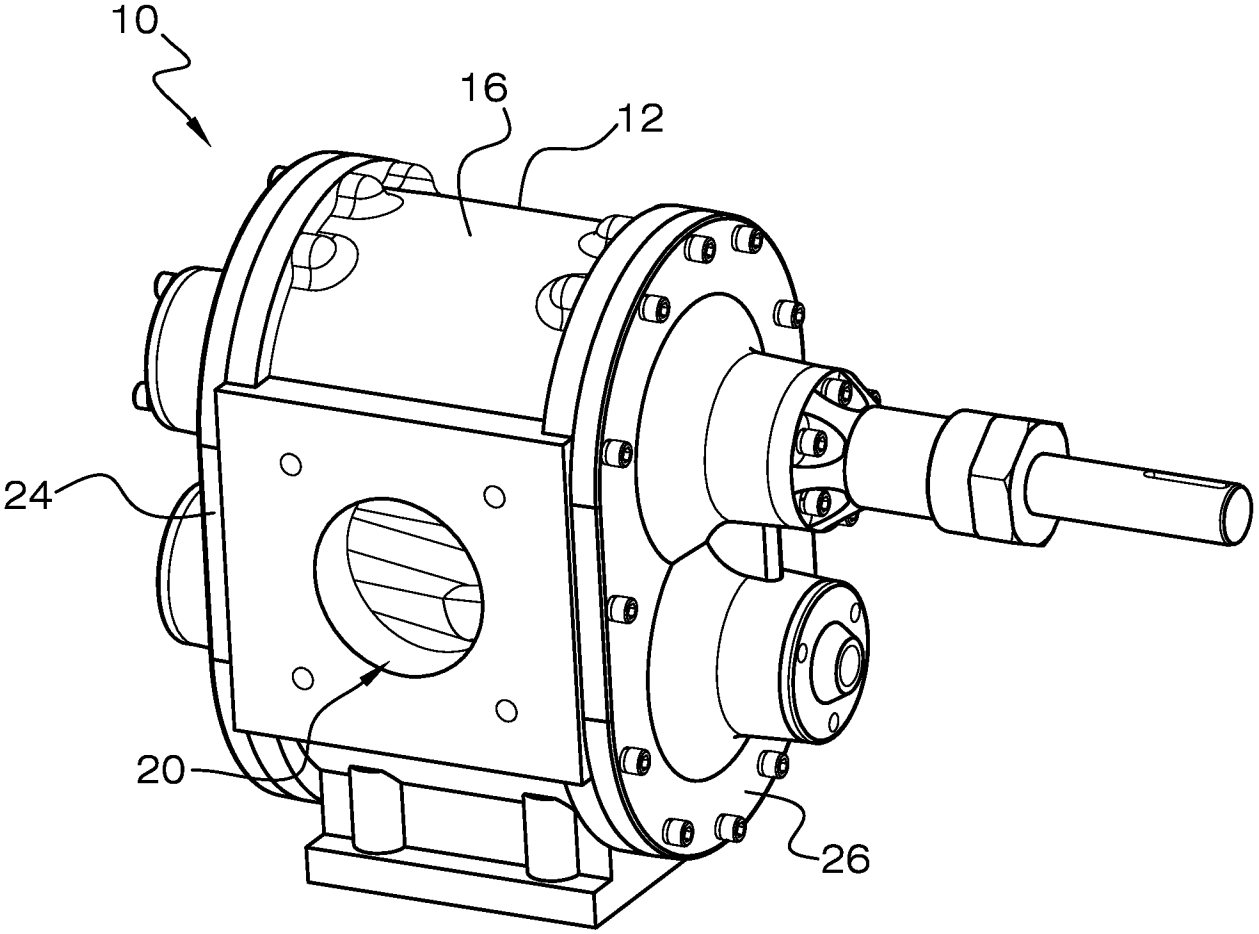
FIG. 1 is perspective view of a gear pump constructed in accordance with the principles of the present invention show assembled.

Schematically illustrated In FIGS. 1-4 is a specially designed gear pump 10 for pumping liquids and fluids, such as oils and distillates containing entrained contaminates such as sand, girt and the like. The gear pump 10 is of the external gear pump type having a driving gear and a driven gear which are disposed within a pump cavity of the gear pump which mesh with each other. The two gears rotate to move a fluid caught in their tooth spaces from a suction side toward a discharge side, thereby performing a pumping action.

Gear pump 10 includes a pump housing 12 having opposite open ends 14, 15 and a sidewall 16 extending therebetween. Sidewall 16 forms a pump cavity 18 and includes opposing suction/discharge ports 20 and 22 extending through the sidewall and into the pump cavity. A pair of end plates 24, 26 are sealingly attached to ends 14, 15, respectively, and seal the pump cavity 18. Each end plate 24, 26 includes a plurality of peripherally disposed fastener mounts such as bolt holes 28 which are used to fasten the end plate to the pump housing 12 by bolts 30.

A pair of meshing gears 32 and 34 are disposed within the pump cavity 18 and extend between end plates 24, 26. Gear 32 is supported by pump shaft 36 which is the pump driving shaft. Gear 34 is supported by pump shaft 38 which is the pump idler shaft. The gears 32, 34 are fixedly secured to driving shaft 36 and idler shaft 38, respectively, for conjoined rotation therewith. To eliminate undesirable play between the gear and shaft, and undesirable meshing between gears 32, 34 during high torque startup, the conventional key and keyway coupling between shaft and gear is replaced by shrink fitting gears 32, 34 to the driving shaft 36 and idler shaft 38, respectively. In this manner, gear 32 and driving shaft 36 become a unitary assembly, and gear 34 and idler shaft 38 become a unitary assembly. The unitary gear/shaft assemblies eliminates vibration between the gear and shaft which serves to reduce pump noise, increase life expectancy of the gears, and to reduce cavity phenomena.

Gears 32, 34 are double-helical gears. The use of double-helical gears eliminates the problem of axial thrust on the pump shafts 36, 38 that is presented by "single" helical gears by having two sets of teeth that are set in a V shape. Each gear in a double helical gear can be thought of as two standard mirror image helical gears stacked. This cancels out the thrust since each half of the gear thrusts in the opposite direction. In this manner the use of wear plates employed to prevent end plate wear in gear pumps is eliminated, and thus reduces the cost of manufacture and maintenance of the gear pump.

Still referring to FIGS. 1-4, end plates 24, 26 are of a similar construction and each include an inward facing side 40 and an opposed outward facing side 42. In some aspects, end plates 24 and 26 are interchangeable, and can be mounted on either ends 14, 15 of pump housing 12. Outward facing side 42 includes a pair of bearing cups or mounts 44, 46 extending outwardly therefrom. First and second shaft passages 48, 50 extend through end plate 24, 26 from the inward facing side 40 through bearing cups 44, 46, respectively, to the outward facing side 42. Bearing cup caps 52A, 52C are sealing attached to the outward facing side of end plate 24 and seal bearing cups 44, 46, respectively. Bearing cup cap 52D is sealing attached to the outward facing side of end plate 28 and seals bearing cup 46. A packing neck 54 is sealing attached to the outward facing side 42 of end plate 28 and seals bearing cup 44. Bearing cup caps 52A, 52B and 52C can be fitted with grease zurks to permit greasing of the shaft bearing assemblies positioned therein.

Figure 3:
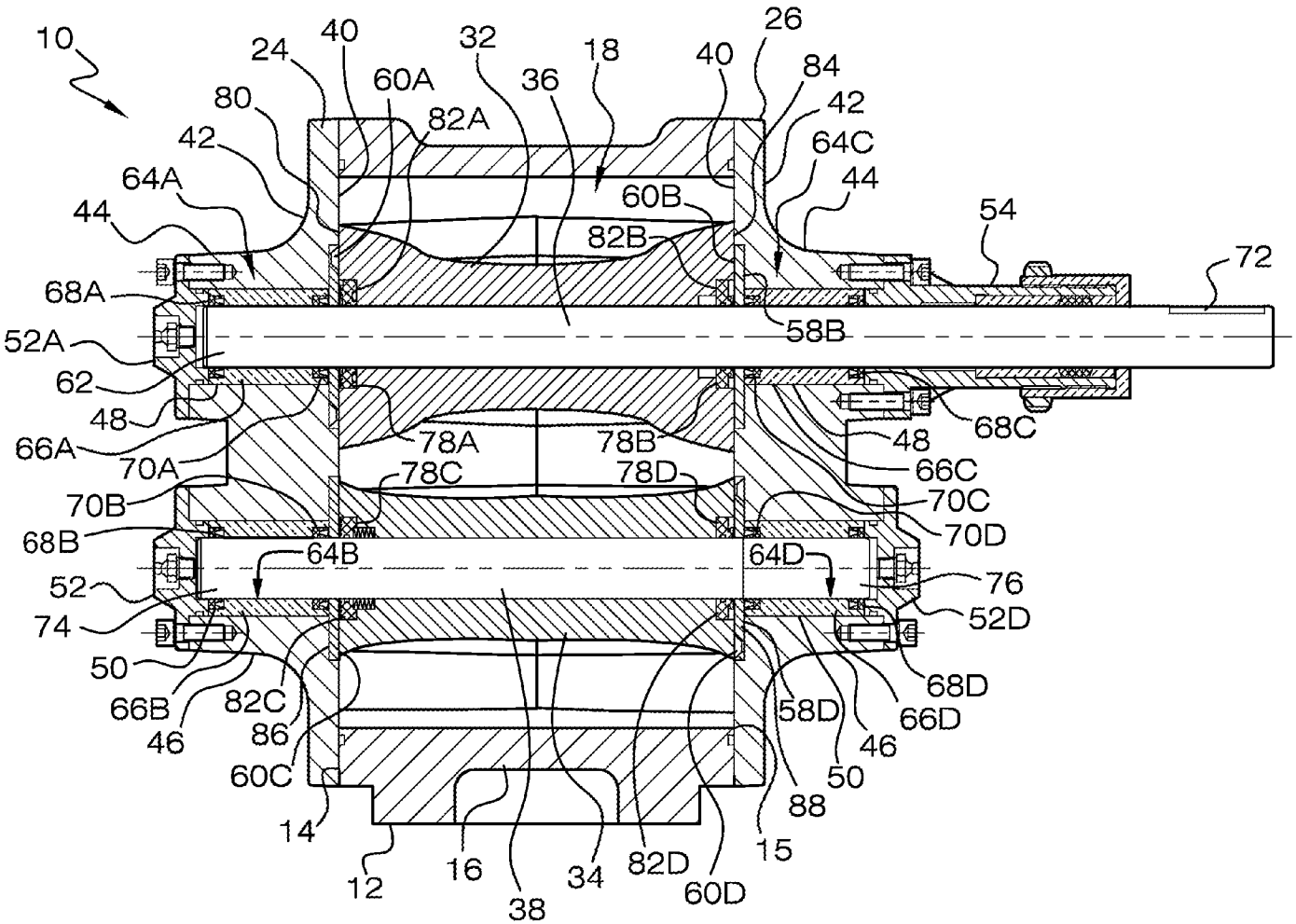
FIG. 3 is a cross sectional view of the gear pump taken along line 3-3 in FIG. 2.
Figure 4:
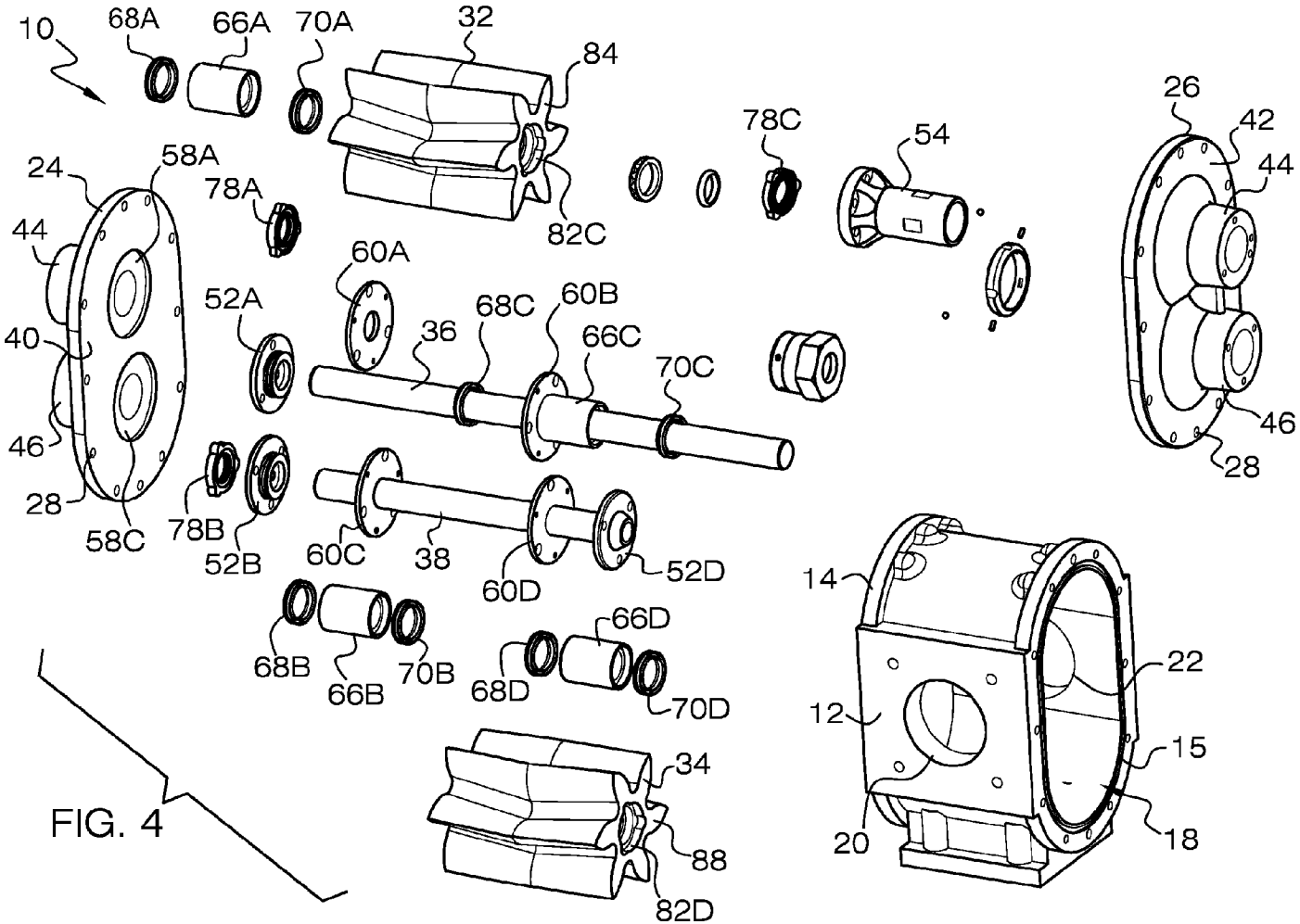
FIG. 4 is an exploded view of the gear schematically illustrating components of the gear pump.

Referring to FIGS. 3 and 4, end plate 24 includes seal disc mounts 58A and 58C on the inward facing side 40 thereof and coaxial with shaft passages 48 and 50, respectively. Likewise, end plate 26 includes seal disc mounts 58B and 58D on the inward facing side 40 thereof and coaxial with shaft passages 48 and 50, respectively. Seal discs 60A, 60B, 60C, and 60D are mounted to seal disc mounts 58A, 58B, 58C, and 58D, respectively, and cover the inward facing opening of the bearing cups 44, 46 of each end plate 24, 26. In embodiments, seal disc mounts 58A, 58B, 58C, and 58D are each a recess formed on the inward facing side 40 of end plates 24 and 26, respectively, into which seal discs 60A, 60B, 60C, and 60D are received. Seal discs 60A, 60B, 60C, and 60D may be fastened to end plates 24 and 26, respectively by threaded fasteners. In embodiments, seal discs 60A, 60B, 60C, and 60D are flush with the inward facing side 40 of end plates 24 and 26, respectively. Seal discs 60A, 60B, 60C, and 60D may also be referred to as pressure washers at they each taking loading forces from gear end seals, as further described below.

Still referring to FIGS. 3 and 4, end 62 of the driving shaft 36 extends through seal disc 64A and into shaft passage 48 of end plate 24 and is supported for rotation by bearing assembly 64A disposed in bearing cup 44. Bearing assembly 64A includes a bushing 66A which supports end 62 for rotation and a pair of end seals 68A and 70A that are disposed within recesses formed in opposing ends of bushing 66A. End seals 68A and 70A provide sealing contact between the driving shaft 36 and bushing 64A. Further, end seal 68A provides a sealing contact between the bearing cup facing side of seal disc 58A and bushing 66A.

The opposite end 72 of driving shaft 36 extends through seal disc 64C, shaft passage 48 of end plate 26 and through packing neck 54. End 72 is supported for rotation by bearing assembly 64C disposed in bearing cup 44. Bearing assembly 64C includes a bushing 66C which supports end 72 for rotation and a pair of end seals 68C and 70C that are disposed within recesses formed in opposing ends of bushing 66C. End seals 68C and 70C provide sealing contact between the driving shaft 36 and bushing 66C. Further, end seal 68C provides a sealing contact between the bearing cup facing side of seal disc 58C and bushing 66C.

Likewise, end 74 of idler shaft 38 extends through seal disc 58B and into shaft passage 50 of end plate 24, and is supported for rotation by bearing assembly 64B disposed in bearing cup 46. Bearing assembly 64B includes a bushing 66B which supports end 74 for rotation and a pair of end seals 68B and 70B that are disposed within recesses formed in opposing ends of bushing 66B. End seals 68B and 70B provide sealing contact between the idler shaft 38 and bushing 66B. Further, end seal 68B provides a sealing contact between the bearing cup facing side of seal disc 58B and bushing 66B The opposite end 76 of idler shaft 38 extends through seal disc 58D and into shaft passage 50 of end plate 26, and is supported for rotation by bearing assembly 64D disposed in bearing cup 48. Bearing assembly 64D includes a bushing 66D which supports end 76 for rotation and a pair of end seals 68D and 70D that are disposed within recesses formed in opposing ends of bushing 66D. End seals 68D and 70D provide sealing contact between the idler shaft 38 and bushing 66D. Further, end seal 68D provides a sealing contact between the bearing cup facing side of seal disc 58D and bushing 66D.

Still referring to FIGS. 3 and 4, gear end seal 78A is disposed about driving shaft 36 and between the inward facing side of seal disc 58A and end 80 of gear 32. Gear end seal 78A provides a sealing contact between end 80 of gear 32 and the inward facing side of seal disc 58A. Gear end seal 78A is mounted to gear end mount 82A on end 80 of gear 32. Gear end seal 78C is disposed about driving shaft 36 and between the inward facing side of seal disc 58C and end 84 of gear 32. Gear end seal 78C provides a sealing contact between end 84 of gear 32 and the inward facing side of seal disc 58C. Gear end mounts 82A and 82C are recesses in ends 80 and 84, respectively which gear end seals 78A and 78C are disposed.

Gear end seal 78B is disposed about idler shaft 38 and between the inward facing side of seal disc 58C and end 86 of gear 34. Gear end seal 78B provides a sealing contact between end 86 of gear 34 and the inward facing side of seal disc 58B. Gear end seal 78B is mounted to gear end mount 82B on end 88 of gear 34. Gear end seal 78D is disposed about idler shaft 38 and between the inward facing side of seal disc 58D and end 88 of gear 34. Gear end seal 78D provides a sealing contact between end 88 of gear 34 and the inward facing side of seal disc 58D. Gear end mounts 82B and 82D are recesses in ends 86 and 88, respectively which gear end seals 78B and 78D are disposed. In embodiments, gear end seals 78A, 78B, 78C and 78D are floating seals. However, it is contemplated the floating seals could be replaced with non-floating seals and provide a sealing contact as intended.

Fluids from the pump cavity 18 are kept from contact with bearing assembly 64A by means of end seal 68A, seal disc 58A and gear end seal 78A, from bearing assembly 64B by means of end seal 68B, seal disc 58B and gear end seal 78B, from bearing assembly 64C by means of end seal 68C, seal disc 58C and gear end seal 78C, and from bearing assembly 64D by means of end seal 68D, seal disc 58D and gear end seal 78D. To this end, debris entrained in the pumped fluid are prevented from contact with bearing assemblies 64A, 64B, 64C and 64D, and thus extending the service life thereof.

Figure 5C:
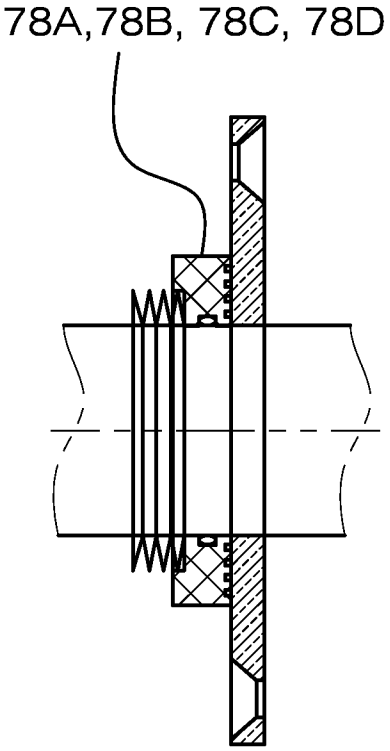
FIGS. 5A-5C schematically illustrate embodiments of floating dynamic seals receivable in gear end seal mounts.
Figure 5B:
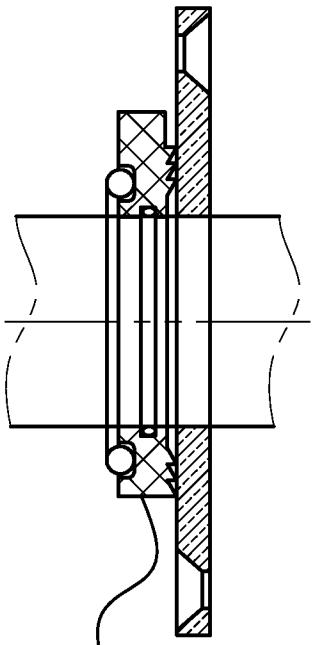
Figure 5A:
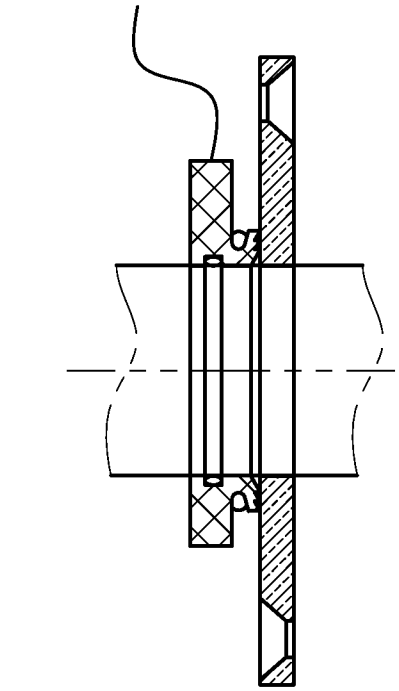
Figure 6:
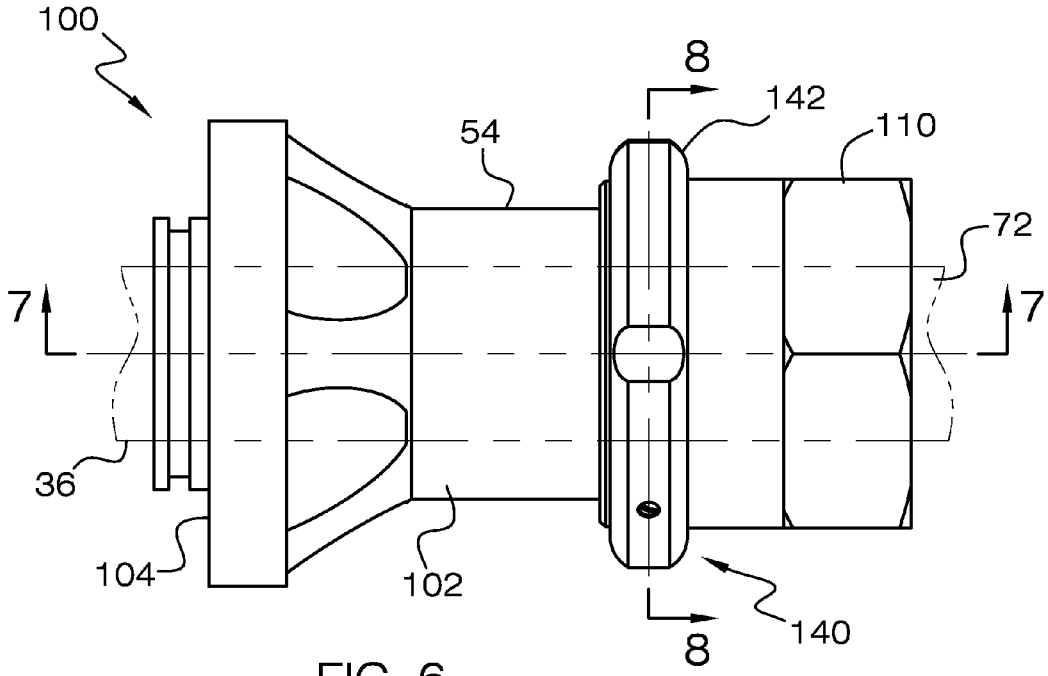
FIG. 6 is an enlarged schematic view of the gear pump seal neck.

With reference to FIGS. 5A, 5B and 5C, a plurality of embodiments of gear end seals 78A-78D are shown. In FIG. 5A, there is shown an elastic frontal labyrinth seal. In FIG. 5B, there is shown a frontal labyrinth seal with O-ring as elastic element. In FIG. 5C, there is shown a frontal labyrinth seal with wave spring as elastic element.

Schematically depicted in FIGS. 6-9, is gear pump 10 having an adjustable driving shaft packing seal assembly 100. Packing seals are conventional used to prevent fluid that is being pumped from leaking through the exposed interface between the protruding pump shaft and the pump housing. As the packing seal becomes worn, the seal begins to fail and leak. Heretofore, the only solution to a worn, leaking packing seal is to shutdown the pump to allow the disassembly and the replacement of the worn packing seal components. The assembly 100, embodied herein, permits an operator to adjust the packing seal as it becomes worn in order to extend the service life of the packing seal without requiring the pump to be shutdown.

Seal neck 54 comprises a body 102 having opposed ends 104 and 106, and a longitudinal shaft passage 108 extending through ends 104 and 106. End 104 is adapted to be mounted to bearing cup 44 with driving shaft 36 extending through shaft passage 108 and beyond end 106 with end 72 protruding externally to permit operable coupling of the driving shaft to a source of rotational power, such as an engine or motor. A pair of bushings 111 and 112 are disposed within shaft passage 108 about driving shaft 36 and provide rotational support to the driving shaft. A packing seal 114, such as a Teflon rope, is interdisposed between bushings 111 and 112 about drive shaft 36, and provides a seal interface between driving shaft 36 and shaft passage 108. A packing nut 110 is threaded onto end 106 of seal neck 54 with driving shaft 36 extending through shaft bore 116.

Bushing 111 is disposed in shaft passage 102 with end 118 thereof abutting against shoulder surface 120 of shaft passage 102 and with the opposite end 122 engaged with end 124 the packing seal 114. End 124 may be inwardly chamfered to provide a seat into which end 124 of the packing seal is received. Busing 112 is disposed in shaft passage 102 with end 126 thereof extending beyond end 106 of seal neck 54 and engaged with surface 128 of the pack nut 110. The opposite end 130 of bushing 112 is engaged with end 132 of packing seal 114. End 130 may be inwardly chamfered to provide a seat into which end 132 of the packing seal 114 is received. Threading packing nut 110 onto seal neck 54 causes bushings 111 and 112 to compress packing seal 114 between ends 118 and 130 of bushings 111 and 112, respectively, and creates a sealing contact between driving shaft 36 and shaft passage 108.

Figure 7:
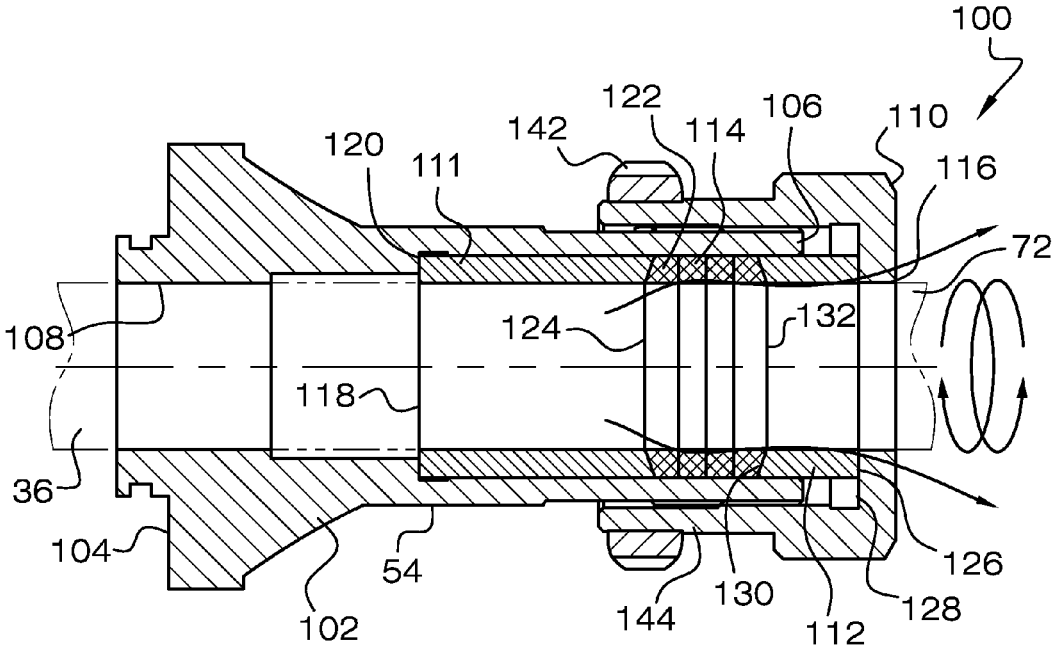
FIG. 7 is an enlarged schematic, cross-sectional view of the gear pump seal neck taken along line 7-7 in FIG. 6, and illustrating an adjustable pump shaft packing seal.
Figure 8:
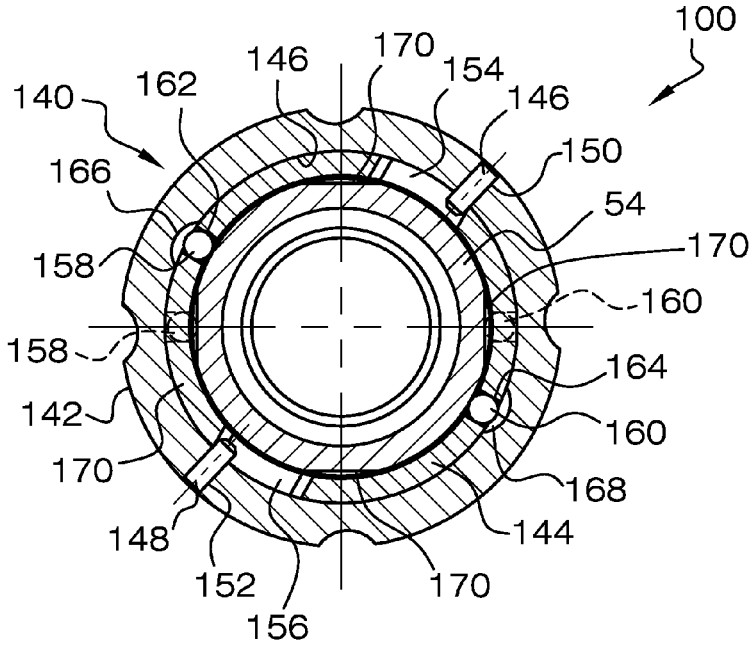
FIG. 8 is an enlarged schematic, cross-sectional view of the seal neck taken along line 8-8 in FIG. 6, and illustrating a lock assembly of the packing nut.
Figure 9:
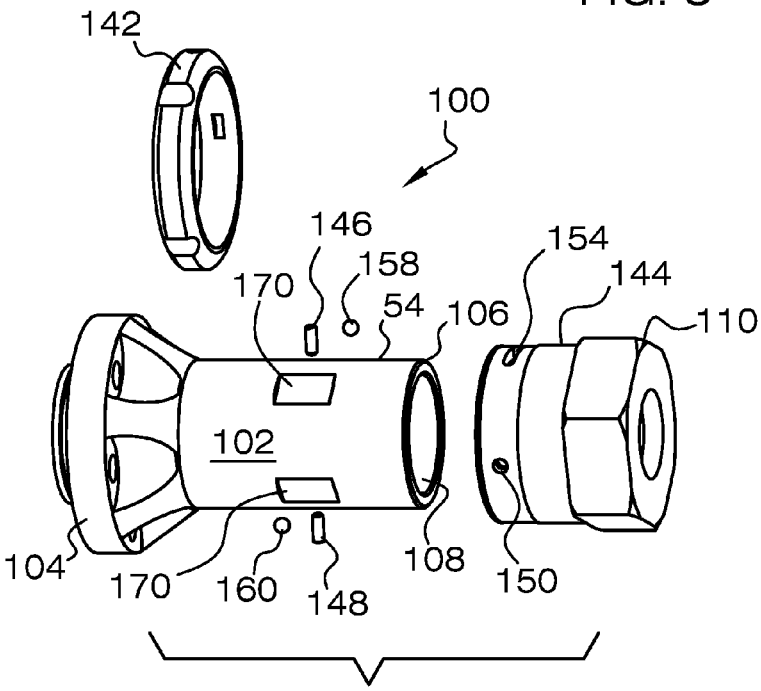
FIG. 9 is an exploded, schematic perspective view of the seal neck, packing nut and packing nut lock assembly.

The assembly 100 further includes a packing nut lock 140 that operates to either preclude the turning of packing nut 110 when moved into one position or to permit the turning of packing nut when moved into another position. As best seen in FIGS. 7 and 8, the packing nut lock 140 includes a collar 142 fitted about packing nut body 144. Collar 142 is secured to body 144 for axial rotation about packing nut body by a pair of pins 146 and 148 that are inserted through holes 150 and 152, respectively, of collar 142 and at least partially into slots 154 and 156, respectively, of packing nut body 144, as best seen in FIG. 8. In this manner, the collar 142 is limited to a few degrees of rotation about packing nut body 144 between a first position and a second position. The assembly of collar 142 with packing nut body 144 captivity retains a pair of check balls 158 and 160 in holes 162 and 164, respectively, of the packing nut body 144 by the inner surface 146 of the collar. A plurality of flat lands 170 are circumferentially located on the exterior surface of the seal neck 54.

When collar 142 is rotated into the first or ON position, as shown in FIG. 8, cavities 166 and 168, formed on the interior surface of collar 142, are registered with holes 162 and 164. This registration permits check ball 158 to be partially received by cavity 166 and check ball 160 to be partially received by cavity 168. In this manner, packing nut 110 is permitted to be rotated about seal neck 54 with check balls 158 and 160 floating over lands 170. When collar 142 is rotated into the second or OFF position, cavities 166 and 168 are moved out of registration with holes 162 and 164, and the inner surface 146 presses check balls 158 and 160 against a flat land 170, as shown in FIG. 8 in dashed line. In this manner, packing nut 110 is precluded from rotating about seal neck 54, and therefore, is locked.

In operation, as packing seal 118 becomes worn and leaks, an operator may further compress the packing seal 118 to tighten the seal between the shaft passage 108 and the driving shaft 36 to preclude the leaking without shutting down the operation of the pump. The packing seal 118 is further compressed by rotating collar 142 into the ON position and then rotating the packing nut 110 further onto the seal neck 54. Once fluid stops leaking, collar 142 is rotated into the OFF position, thereby locking the threaded position of the packing nut 110 on the seal neck.

Figure 2:
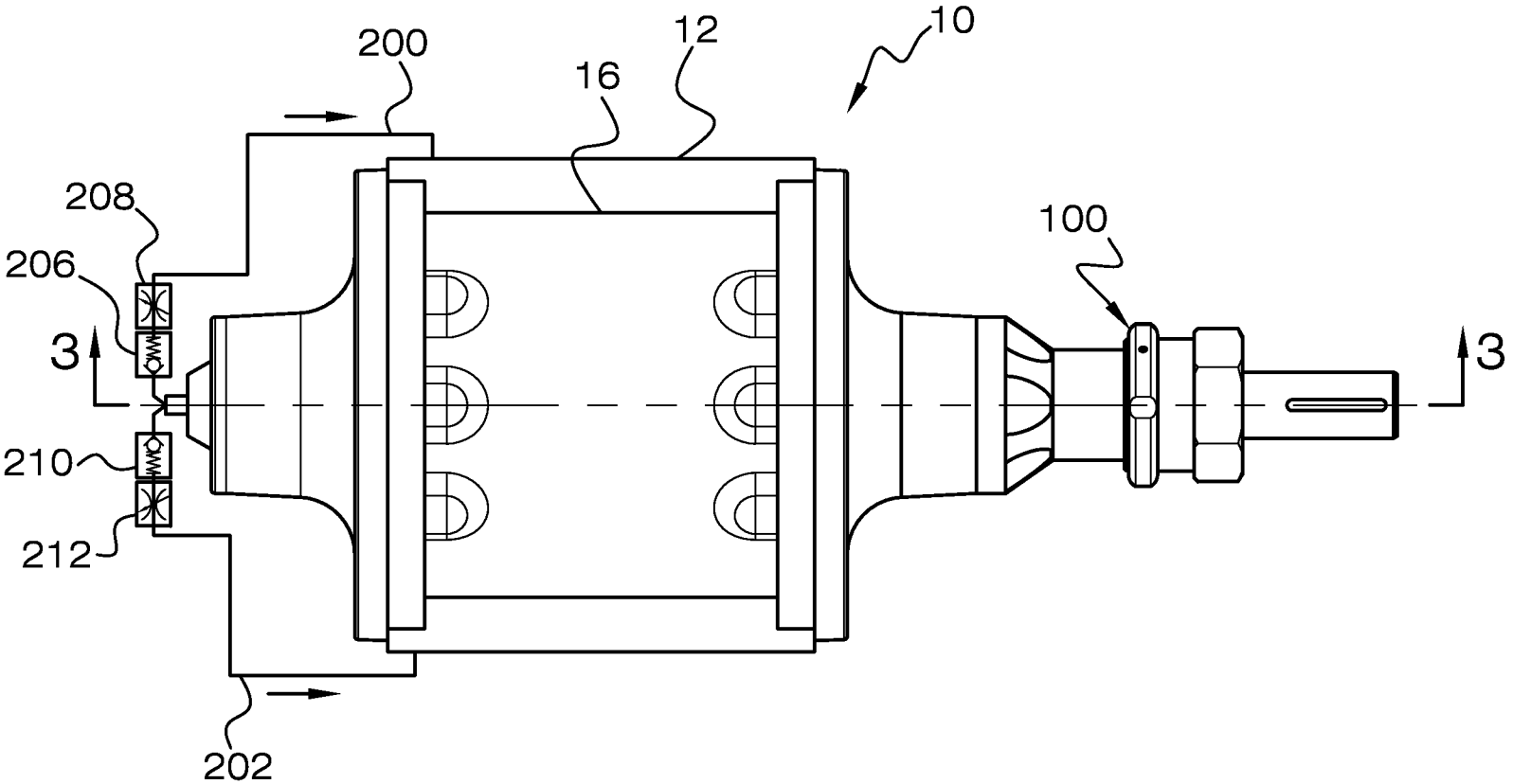
FIG. 2 is a top view of the gear pump schematically illustrating a pressure relieving system.
Figure 10:
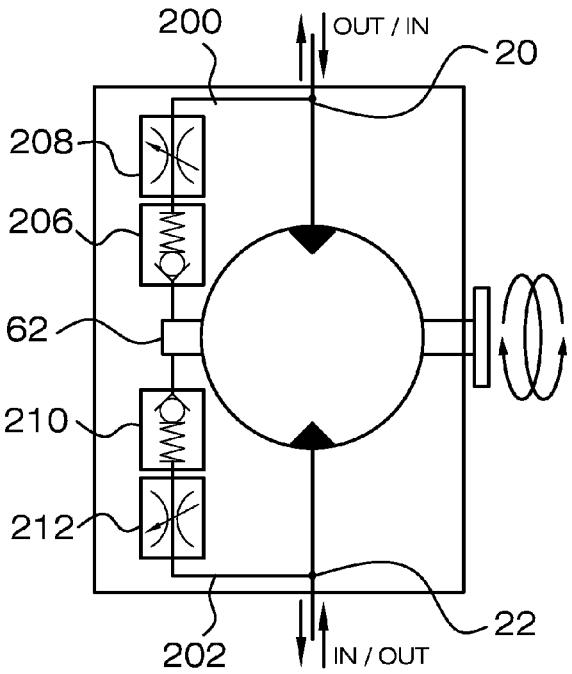
FIG. 10 is a schematic view of a fluid pressure relief system of the gear pump.
Figure 11:
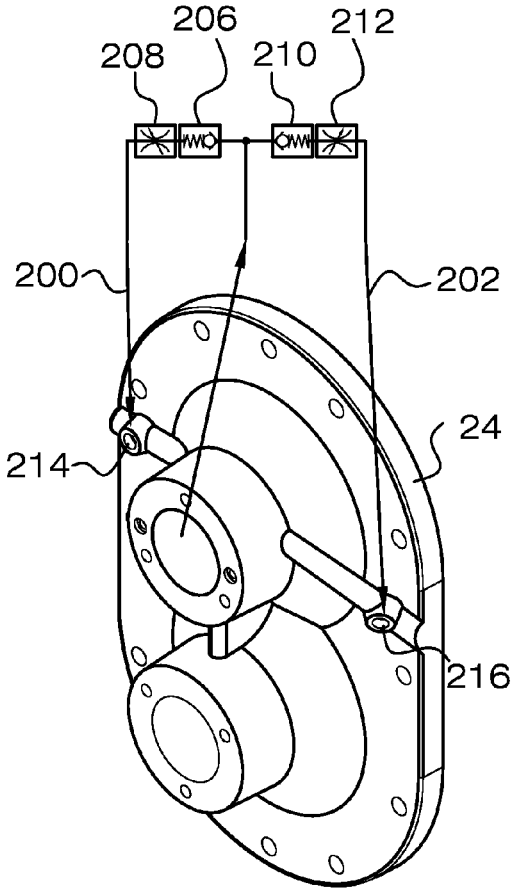
FIG. 11 is perspective view of a modified end plate and schematically illustrating the fluid pressure relieving system.
Figure 12:
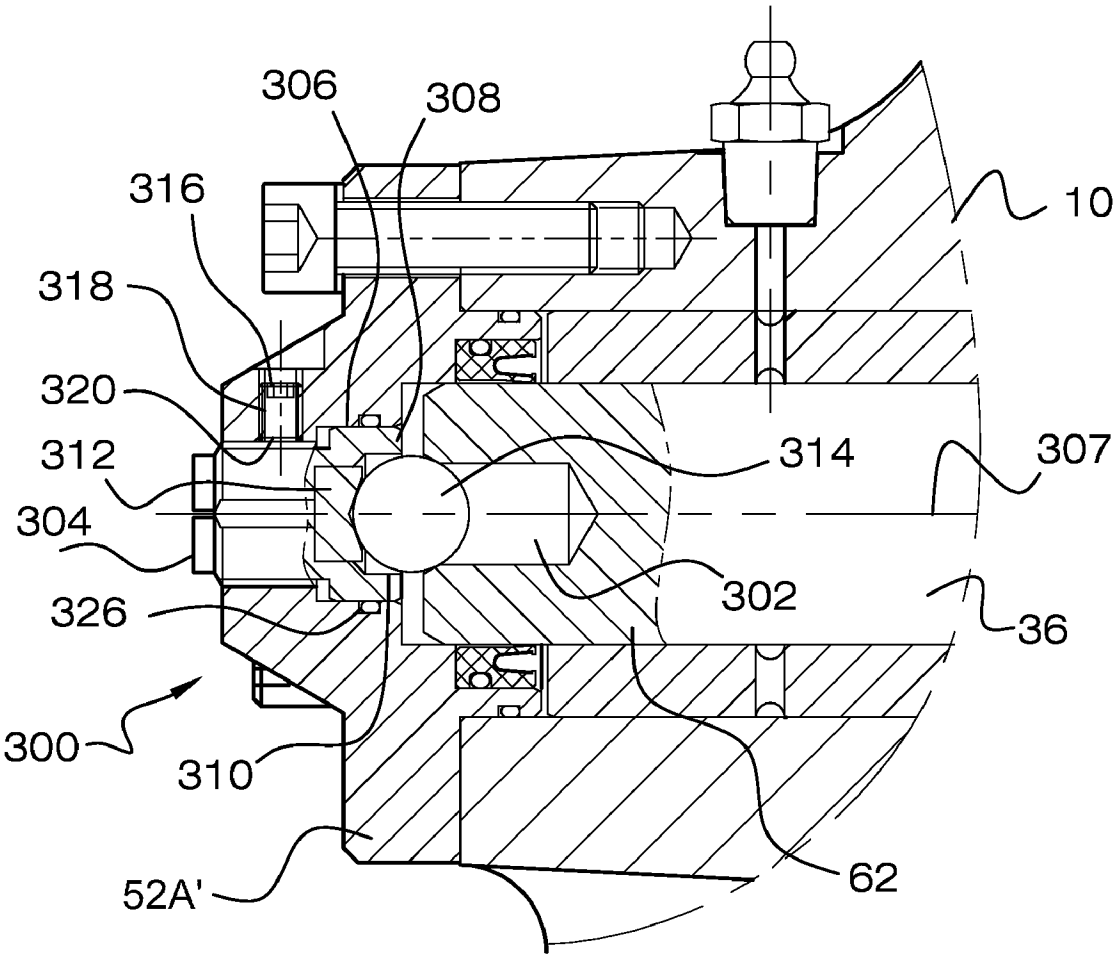
FIG. 12 is an enlarge, partial cross-sectional view of a gear gap adjustment mechanism of the gear pump.
Figure 15:
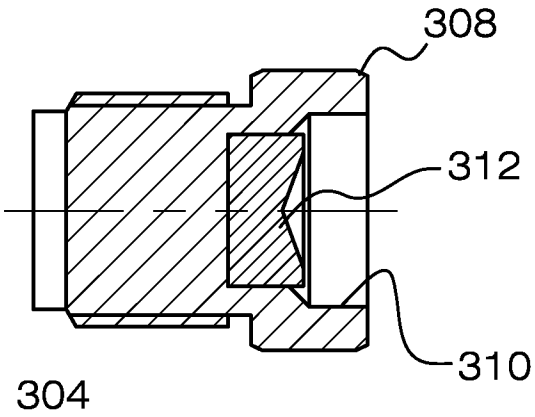
FIG. 15 is an enlarged cross-sectional view of the threaded plug taken along line 15-15 in FIG. 14.
Figure 14:
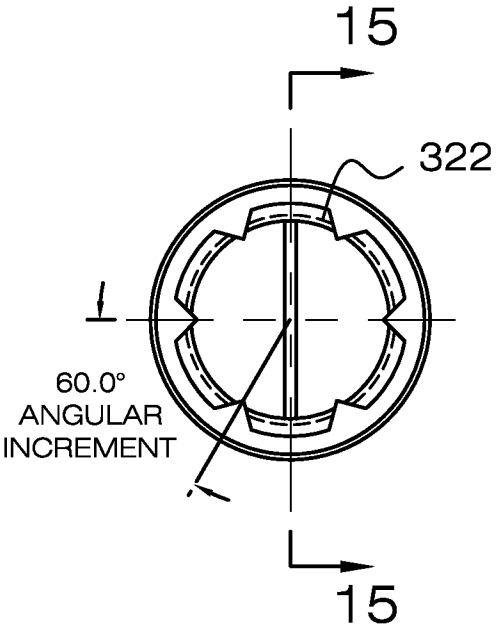
FIG. 14 is an enlarged end view of the threaded plug.
Figure 13:
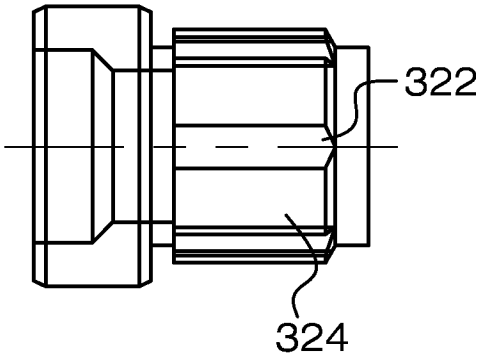
FIG. 13 is an enlarged side elevation view of a threaded plug of the gear gap adjustment mechanism.

Schematically depicted in FIGS. 2 and 10, is gear pump 10 having pressure relief system to vent fluid pressure that may occur at end 62 of driving shaft 36 to prevent axial forces along driving shaft and avoiding end plate wear. The pressure relief system includes first and second fluid passages 200 and 202, each in fluid communication with fluid located at end 62 of the driving shaft 36. The first passage 200 is further in fluid communication with suction/discharge port 20, and the second passage 202 is further in fluid communication with suction/discharge port 22. A check valve 206 and needle valve 208 are positioned across the first passage 200 and a check valve 210 and needle valve 212 are positioned across the second passage 202. Check valves 206 and 210 operate to permit fluid to follow through passages 200 and 202, respectively, only in the direction towards suction/discharge ports 20 and 22. Needle valves 208 and 212 are each adjusted to permit fluid flow through passages 200 and 202, respectively, when fluid at end 62 of the driving shaft 36 is at a threshold pressure. In FIG. 11, end plate 24 is schematically depicted including ports 214 and 216 for connection with fluid passages 200 and 202 with suction/discharge ports 20 and 22, respectively. Needle valves 208 and 212 are optional. Additionally, while the pressure relief system is illustrated and described with reference only to end 62 of driving shaft 36, the pressure relief system can be employed to release pressure at the ends of any of the pump shafts.

Schematically depicted in FIGS. 12-15, is gear pump 10 having a gear gap control mechanism 300 to adjust the meshing of gears 32 and 34 by axially displacing driving shaft 36. In this embodiment, bearing cup cap 52A is replaced by bearing cup cap 52A' and end 62 of driving shaft 36 has been milled to include axial bore 302. Mechanism 300 further includes a plug member 304 threadably received by bore 306 that extends through end plate 24 along longitudinal axis 307 of driving shaft 36. Inward end 308 of plug 304 includes bore 310 into which is disposed is cup member 312. Ball 314 is interdisposed between end 62 of the driving shaft 36 and cup member 312, and is partially seated within cup member 312 and axial bore 302. Ball 314 provides a dynamic bearing interface between cup member 312 and end 62 of the driving shaft 36. Threading plug 304 into bore 306 causes ball 314 to urge against end 62 of the driving shaft 36. Further threading of plug 304 into bore 306 results in a longitudinal displacement of driving shaft 36 along axis 306, and thus moves the longitudinal position of gear 32 relative to the longitudinal position of gear 34. The threaded position of plug 304 can be adjusted to control relative longitudinal positions of gears 32 and 34, and thus the gap between the gear teeth. The threaded position of plug 304 can be locked in place by a screw or threaded pin 316 threadably received within bore 318 that extends normal to bore 306. Threading pin 316 into bore 318 caused end 320 of the pin to be received by one of a plurality of circumferentially spaced and longitudinally extending grooves 322 on the exterior of plug barrel 324, and thus locking plug 304 from rotation within bore 306. An O-ring seal 326 can provide a sealing interface between bore 306 and plug 304. Additionally, while the gap control is illustrated and described with reference only to end 62 of driving shaft 36, the gap control can be employed at the ends of any of the pump shafts.

Figure 16:
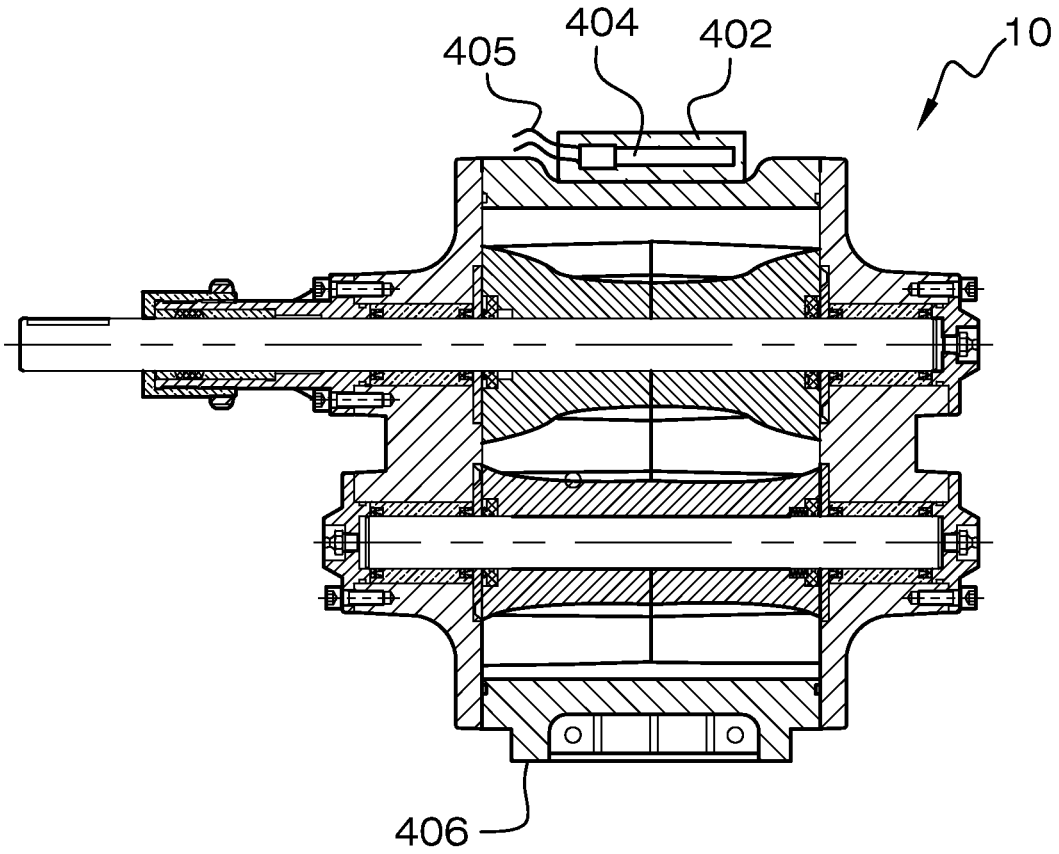
FIG. 16 is a schematic cross-sectional view of the gear pump including heat exchange features.
Figure 17:
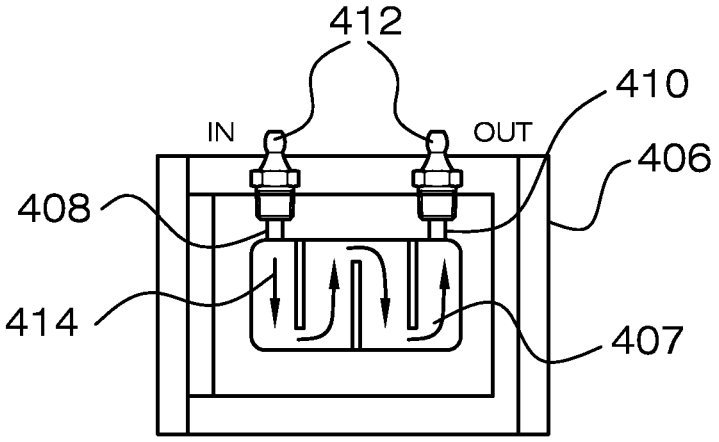
FIG. 17 is a schematic view of a fluid medium heat exchange feature.

Schematically depicted in FIGS. 16 and 17, is gear pump 10 having one or more heat exchange features to either cool the gear pump in hot climates or heat the gear pump in cold climates. In one aspect, a heat exchanger body 402 is mounted to the exterior of the pump housing 12, for example by welding. One or more electric heating elements 404 are disposed within body 402 that are operably connected to a source of electrical power (not shown) by leads 405. When operating, electric heating elements 404 output radiant heat that is transmitted into the pump casing 12 and heating the components of the pump 10 to prevent lockup due operating in cold climates. In another aspect, a heat exchanger body 406 is mounted to the exterior of the pump housing 12, for example by welding. Body 406 include an internal serpentine fluid flow passage 407 extending between inlet and out let ports 408 and 410. Ports 408 and 410 are fitted with couplings 412 that permit the flow passage 407 to be fluidically connected to an engine cooling system (not shown) to receive the flow of antifreeze or other heat exchanging fluid medium 414 from the engine cooling system. The flow of fluid through flow passage 407 heats or cools the pump housing 12 and thus the pump components to prevent lockup due to freezing weather or from over heating.

A number of embodiments of the present invention have been described. Nevertheless, it will be understood that various modifications may be made without departing from the spirit and scope of the invention. Accordingly, other embodiments are within the scope of the following claims.

What is claimed is:

1. A gear pump, comprising:

a pump housing having opposite ends;

a gear disposed within said pump housing, said gear having opposed and outwardly facing first and second ends, said first end having a first gear end seal mount, and said second end having a second gear end seal mount;

first and second end plates sealingly joined to said opposite ends of said pump housing, said first end plate having a first shaft passage to receive a pump shaft therethrough and a first seal disc mount on an inner side of said first end plate coaxial with said first shaft passage, said second end plate having a second shaft passage to receive a pump shaft therethrough and a second seal disc mount on an inner side of said second end plate coaxial with said second shaft passage;

a first seal disc mounted to said first seal disc mount;

a second seal disc mounted to said second seal disc mount;

a pump shaft having a first shaft end extending through said first shaft passage and said first seal disc, and a second shaft end extending through said second shaft passage and said second seal disc, and wherein said gear is fixedly joined to said pump shaft for rotation therewith;

a first gear end seal mounted to said first gear end seal mount and forming a sealing contact between an inner facing side said first seal disc and said first outwardly facing end; and a second gear end seal mounted to said second gear end seal mount and forming a sealing contact between an inner facing said second seal disc and said second outwardly facing end.

2. The gear pump of claim 1, wherein said gear pump includes first and second discharge/suction ports;

said gear pump further comprising a first fluid flow passage between said first shaft end and said first discharge/suction port, and a second fluid flow passage between said first shaft end and said second discharge/suction port; and a fluid at said first shaft end flowing through either of said first or said second fluid passage upon said fluid reaching a pressure above a threshold pressure to vent said fluid at said first shaft end to either of said first or said second discharge/suction ports, respectively.

3. The gear pump of claim 2, further comprising a first needle valve and check valve pair across said first fluid flow passage controlling fluid flow therethrough, and a second needle valve and check valve pair across said second fluid passage controlling fluid flow therethrough.

4. The gear pump of claim 1, further comprising:

a seal neck including a body having opposed first and second ends and a seal neck shaft passage extending said first and second ends;

said seal neck mounted to said end plate and said pump shaft extending through said seal neck passage and protruding beyond said second end of said seal neck;

first and second bushings disposed in said seal neck shaft passage and supporting said pump shaft for rotation;

a packing seal disposed within said seal neck shaft passage about said pump shaft and interdisposed between said first and said second bushings;

a packing nut including a bore, said packing nut threadably attached to said second end of said body of said seal neck, said pump shaft extending through said bore of said packing nut, wherein threading said packing nut on said second end compresses said packing seal between said first and said second bushings;

a pair of check balls, each disposed in a hole extending through a body of said packing nut;

a collar attached to packing nut about said body thereof, said collar captivity retaining said pair of check balls in said holes, said collar rotatable about said body between first and second positions, said collar including a pair of cavities on an interior surface thereof;

said seal neck including a plurality of flat lands circumferentially spaced on an exterior surface thereof; and wherein said collar is rotated into said first position said cavities are registered with said holes through said packing nut body and said check balls are partially received within said cavities permitting said check balls to float across said flat lands as said packing nut is threaded, and wherein said collar is rotated into said second position said check balls are restrained from floating across said flat lands.

5. The gear pump of claim 1, further comprising:

a plug member threadably received by a plug bore through said first end plate along the axis of said pump shaft said first shaft end of said pump shaft including an axial bore; and a ball disposed between said first shaft end and a cup of an inward end of said plug member.

6. The gear pump of claim 5, further comprising:

a threaded pin, said threaded pin threadably received within a pin bore in said first end plate that extends normal to said plug bore;

said plug member including a plurality of circumferentially spaced and longitudinally extending grooves; and wherein an end of said threaded pin is receivable within one of said grooves to lock the threaded position of said plug member relative to said first end plate.

7. The gear pump of claim 1, further comprising: a heat exchanger body mounted to said pump casing.

8. The gear pump of claim 1, wherein said gear is a double-helical gear.

* * * * *